US005611386A

United States Patent [19]

Wang

[11] Patent Number: 5,611,386

[45] Date of Patent: Mar. 18, 1997

[54] ELECTRIC WINDOW BLIND

[76] Inventor: Ming S. Wang, No. 5, Ell-herng Lane, 1 Lane, dashin Rd., Puuyan hsian, Changhua county, Taiwan

[21] Appl. No.: 571,313

[22] Filed: Dec. 12, 1995

[51] Int. Cl.[6] ..... A47H 5/00

[52] U.S. Cl. ..... 160/344; 160/321; 160/168.1 P; 160/170 R; 160/331; 74/606 R

[58] Field of Search ..... 160/168.1 P, 168.1 V, 160/170 R, 188, 193, 321, 341, 340, 344, 345, 331; 74/606 R, 625

[56] References Cited

U.S. PATENT DOCUMENTS

| | | | |
|---|---|---|---|
| 1,510,352 | 9/1924 | Thompson | 74/606 R X |
| 2,462,498 | 2/1949 | Himoff et al. | 74/625 |
| 2,621,543 | 12/1952 | Rossman | 74/625 |
| 3,789,905 | 2/1974 | Saito | 160/168.1 V |
| 3,801,062 | 4/1974 | Arn et al. | 74/625 X |
| 4,257,192 | 3/1981 | Bartholomew | 74/625 X |
| 4,653,565 | 3/1987 | Iha et al. | 160/193 |
| 5,137,073 | 8/1992 | Huang | 160/321 |
| 5,152,357 | 10/1992 | McLean et al. | 74/606 R X |
| 5,261,372 | 11/1993 | Traeger et al. | 74/625 X |
| 5,270,629 | 12/1993 | Hsieh | 160/331 X |
| 5,353,690 | 10/1994 | Shin | 74/625 X |
| 5,483,426 | 1/1996 | Lewis et al. | 74/606 R X |

*Primary Examiner*—Blair Johnson
*Assistant Examiner*—Bruce A. Lev
*Attorney, Agent, or Firm*—Pro-Techtor International

[57] ABSTRACT

An electric window blind comprises a driving member capable of being actuated by an action rod to cause the rotary wheels to engage the transmission wheels at the time when the power outage takes place. The rotary wheels can be therefore actuated manually so as to keep to electric window blind in an operating condition in the event of a power interruption.

4 Claims, 6 Drawing Sheets

ELECTRIC WINDOW BLIND

FIELD OF THE INVENTION

The present invention relates generally to a window blind, and more particularly to an electric window blind which can be operated manually in case of the power interruption.

BACKGROUND OF THE INVENTION

The conventional electric window blind is generally provided with batteries so as to enable the electric window blind to remain in an operating condition in case of a power outage. However, adding the batteries to the electric window blind is by no means a sure thing that the electric window blind will work at the time when the power outage takes place, in view of the fact that the batteries may have been badly corroded. In addition, the batteries must be replaced periodically with new ones, which result in an increase in the cost of the use of the electric window blind.

SUMMARY OF THE INVENTION

It is therefore the primary objective of the present invention to provide an electric window blind which can be operated even in the event of a power interruption.

In keeping with the principle of the present invention, the foregoing objective of the present invention is attained by an electric window blind, which comprises a driving member capable of being actuated by an action rod to cause the rotary wheels to engage the transmission wheels at the time when the power outage takes place. The rotary wheels can be therefore actuated manually so as to keep the electric window blind in an operating condition in the event of the power interruption.

DETAILED DESCRIPTION OF THE INVENTION

Figure 1:
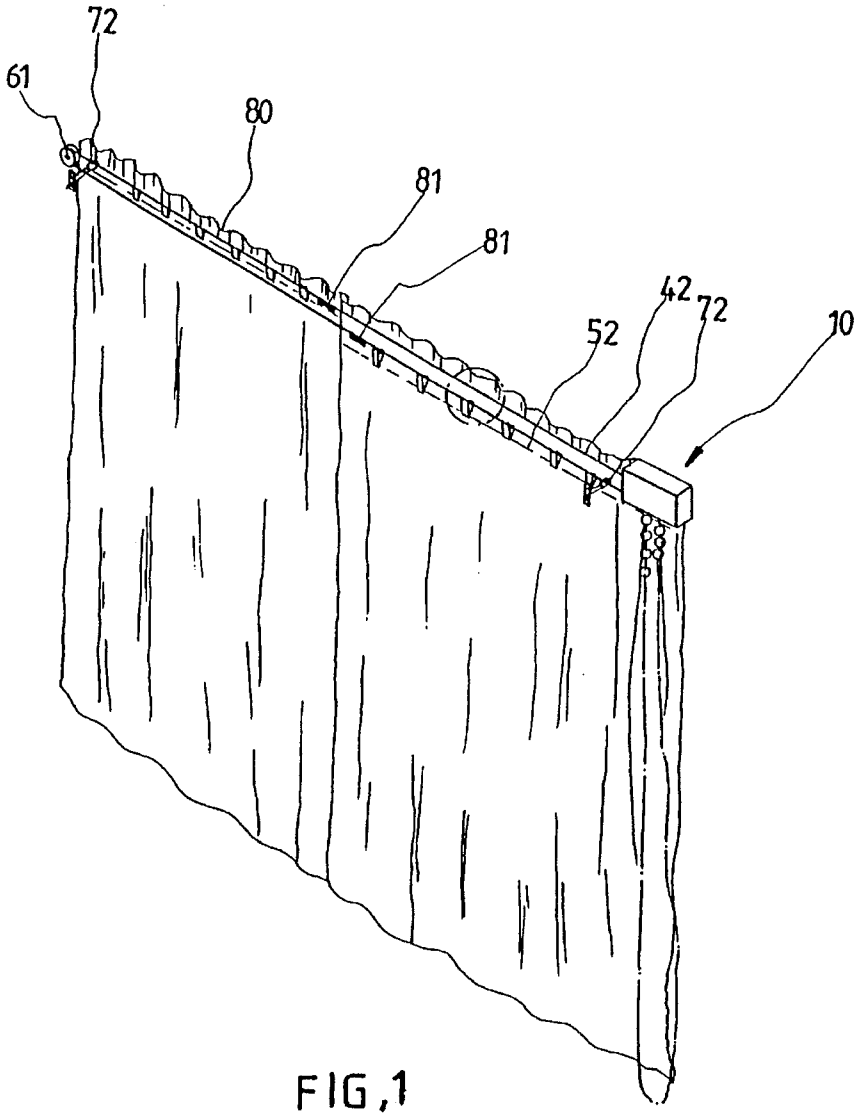
FIG. 1 shows a perspective view of the present invention.
Figure 1A:
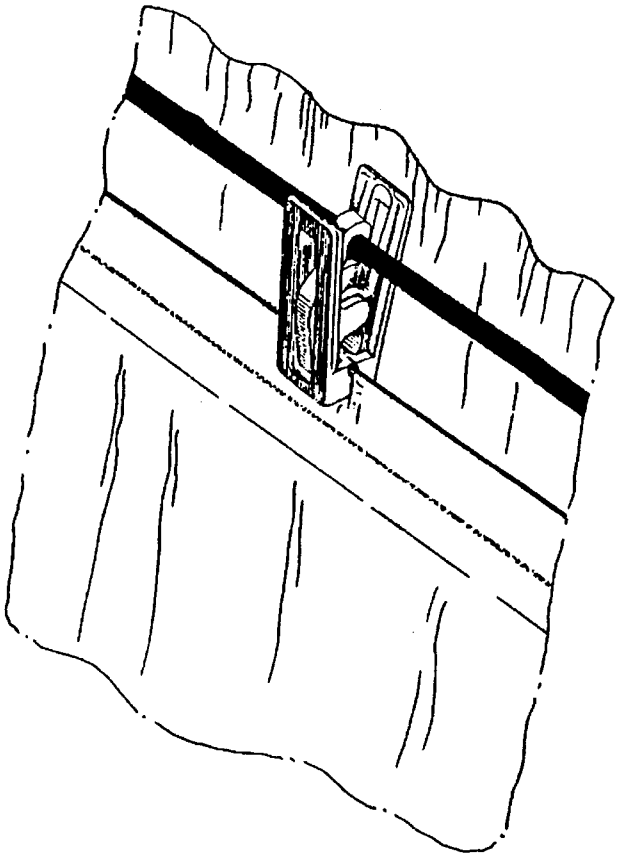
Figure 2:
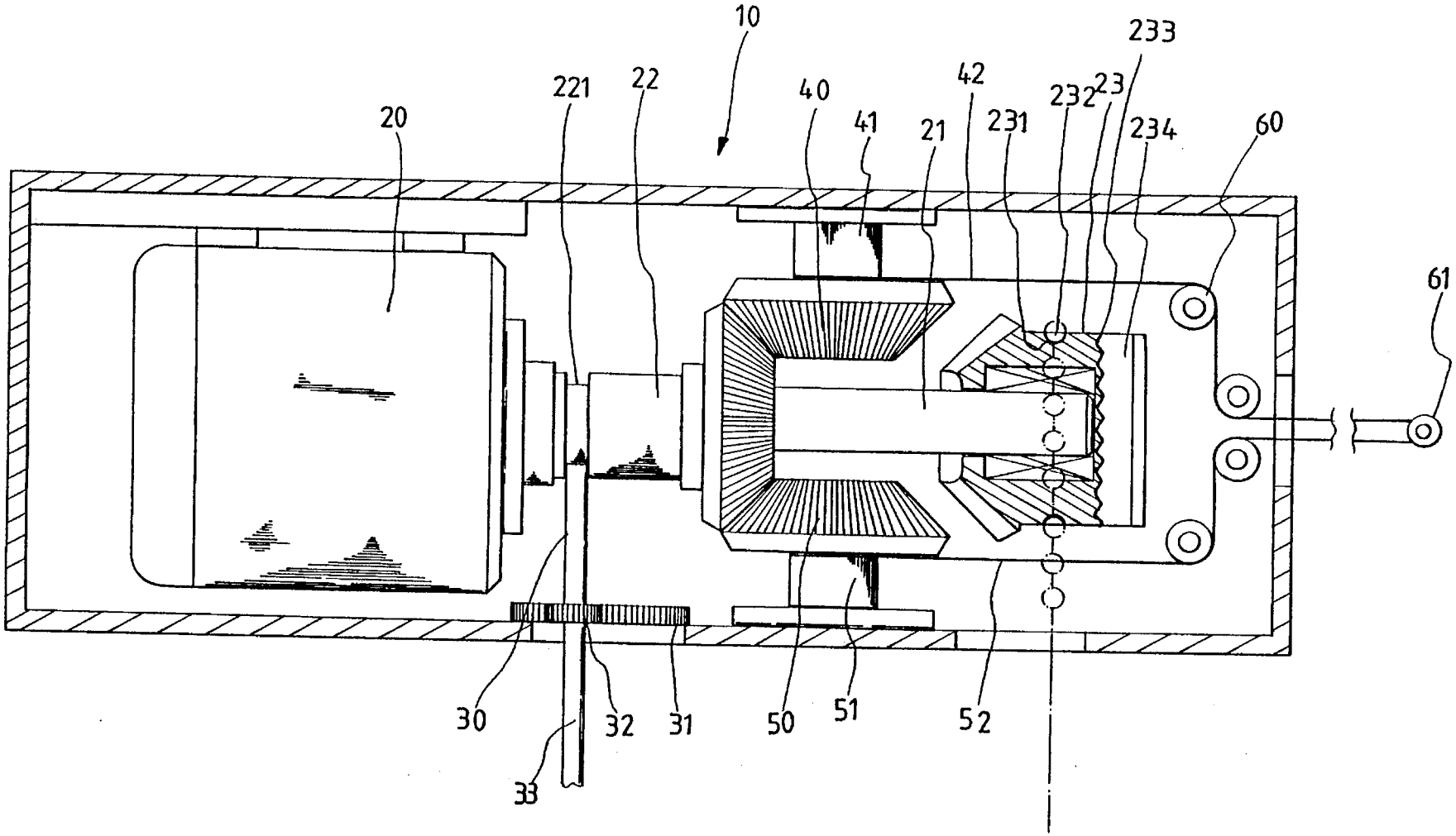
FIG. 2 shows a schematic plan view of a transmission set of the present invention.
Figure 3:
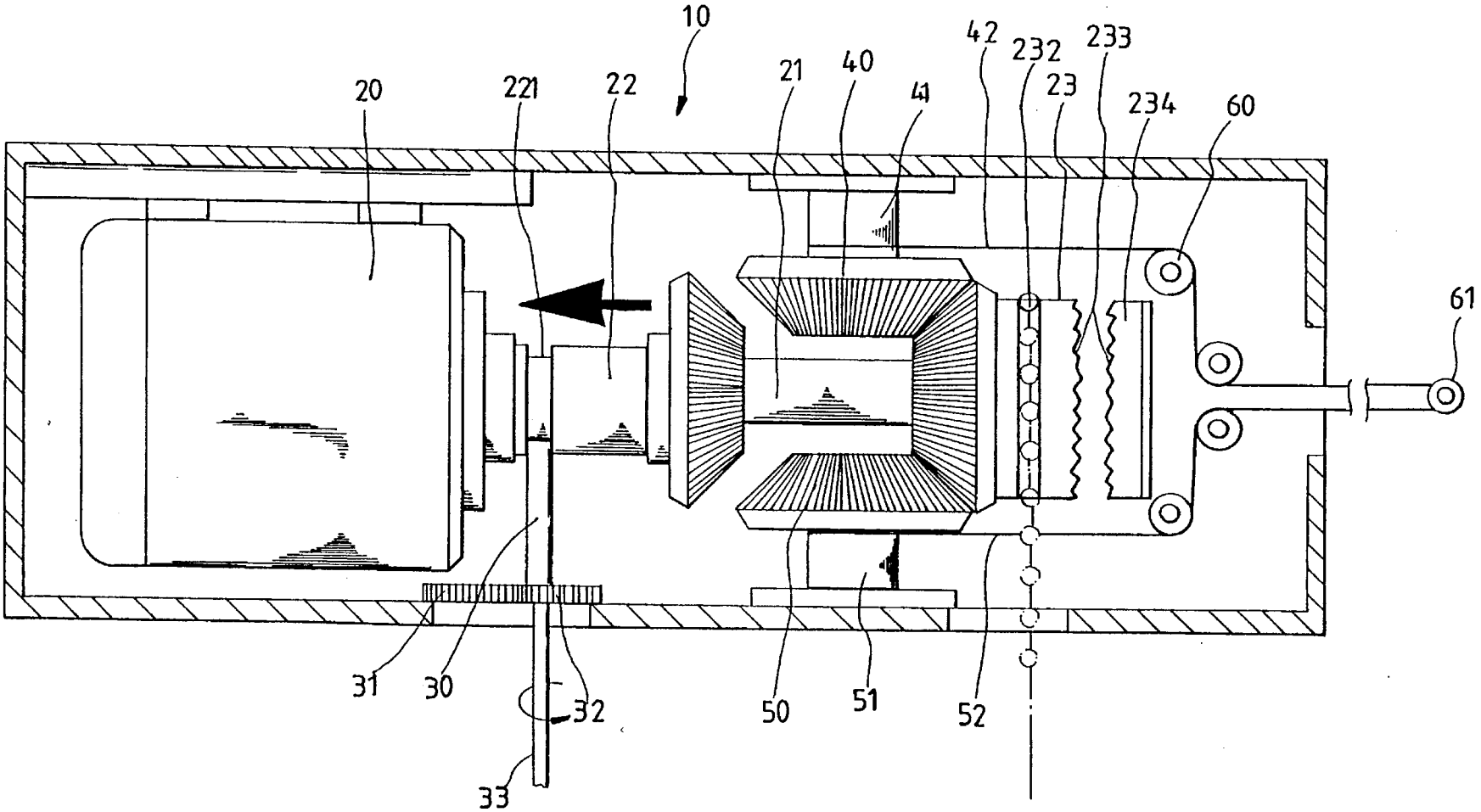
FIG. 3 shows a schematic view of the transmission set at work according to the present invention.
Figure 4:
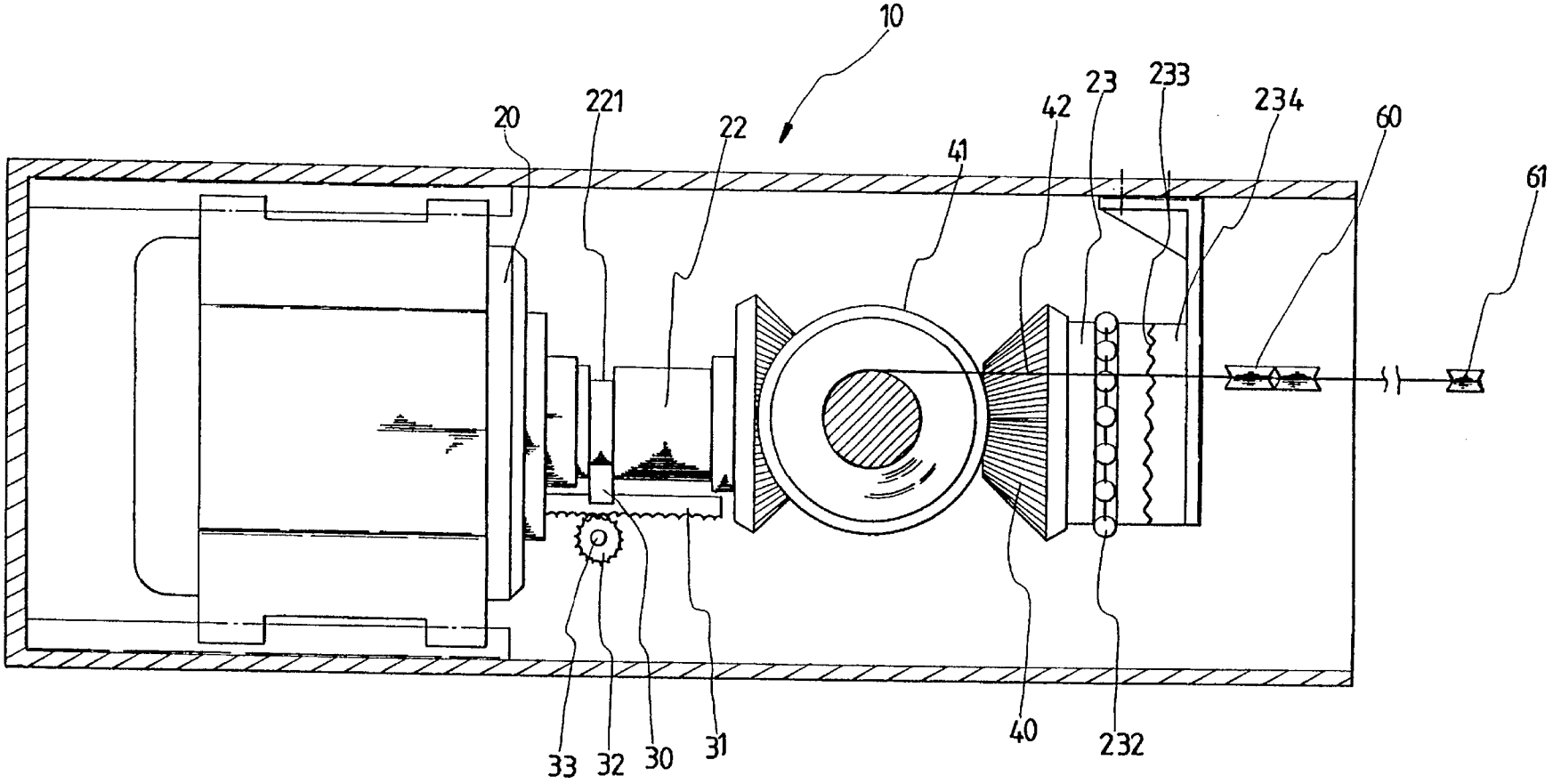
FIG. 4 shows a top plan view of the transmission set of the present invention.

As shown in FIGS. 1–4, an electric window blind of the present invention comprises a transmission set 10, which comprises a motor 20 having a shaft 20 on which two rotary wheels 22 and 23 are mounted. The rotary wheel 22 is provided with a recessed portion 221 to which an action rod 30 is fastened. The action rod 30 is provided at the bottom end thereof with a threaded portion 31 engageable with a gear 32 mounted on a rod 33. The rotary wheel 23 is provided with a plurality of holes 231 which are provided therein respectively with a ball 232. The rotary wheel 23 is provided at one end thereof with retaining teeth 233 opposite to an arresting block 234. Located between the rotary wheel 22 and 23 are two transmission wheels 40 and 50, which are provided respectively with the cord winding wheels 41 and 51 on which the cords 42 and 52 are wound respectively. The cords 42 and 52 are fastened respectively at one end thereof with a locating idle wheel 61 via a plurality of idle wheels 60.

When the motor 20 is started, the rotary wheel 22 is actuated to turn by the shaft 21. As a result, the transmission wheels 40 and 50 are acutated by the rotary wheel 22 to rotate so as to actuate the cord winding wheels 41 and 51. As the cord winding wheels 41 and 51 are actuated to rotate, the cords 42 and 52 are wound in the direction in which the rotary wheel 22 turns.

When the power supply is interrupted, the gear 32 can be actuated to turn by the rod 33 manually, thereby causing the threaded portion 31 of the action rod 30 and the rotary wheel 22 to displaced rearwards to cause two transmission wheels 40 and 50 to mesh with the rotary wheel 23. The transmission wheels 40 and 50 can be caused manually to turn, thanks to the balls 232 of the rotary wheel 23. In other words, the cords 42 and 52 can be caused to wind or unwind manually in case of a power outage.

As shown in FIG. 1, a blind body 80 is joined with the cords 42 and 52 by means of a holder 70 which is provided with a retaining hook 71 capable of holding the cords 42 and 52. The blind body 80 is provided on one side thereof with a fixation device 81 for fastening the cords 42 and 52. The blind body 80 is provided on another side thereof with an arresting ring 72 for enabling the blind body 80 to be moved by the fixation device 81.

Figure 5:
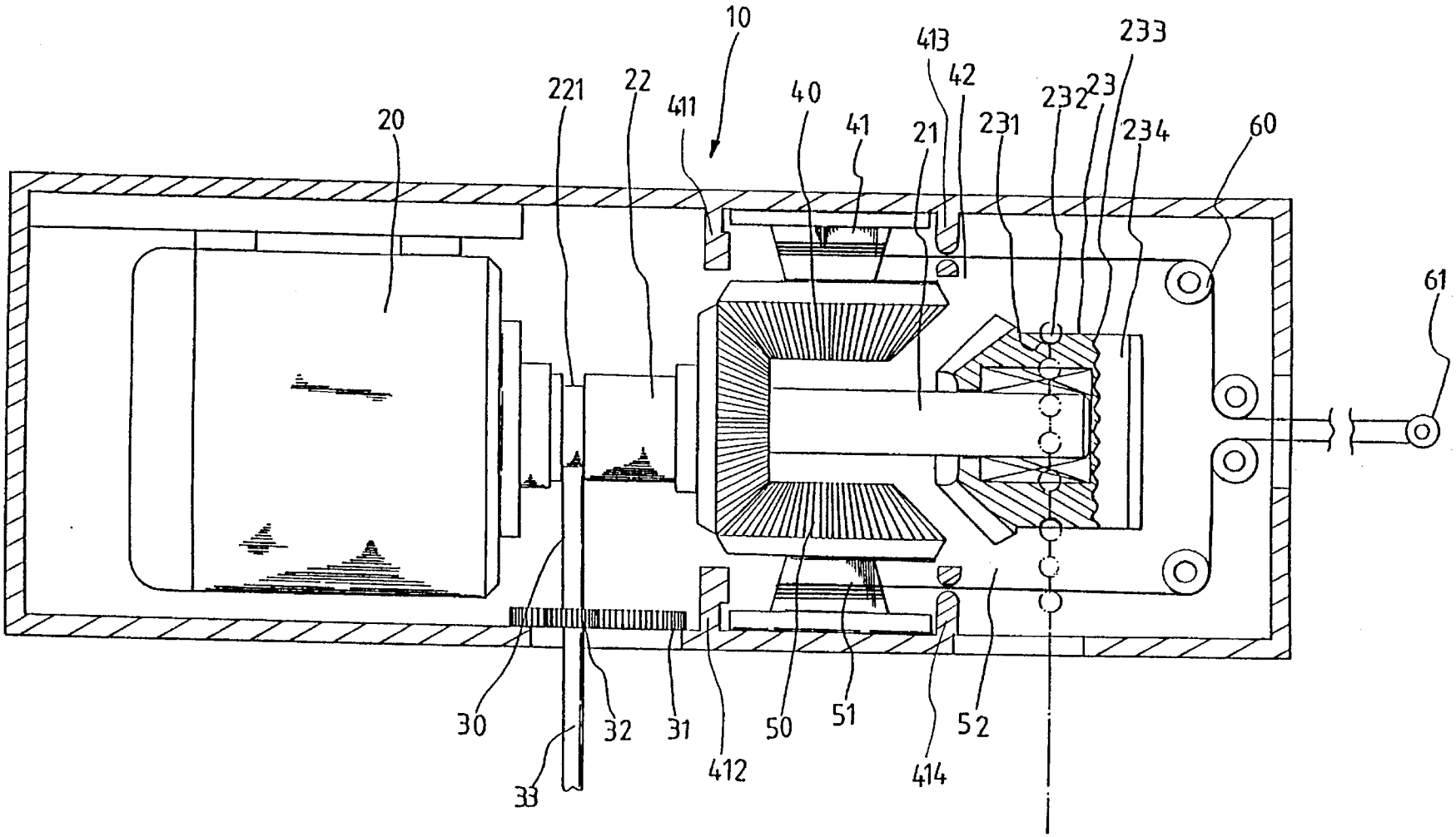
FIG. 5 shows a schematic view of a transmission set of another preferred embodiment of the present invention.

As shown in FIG. 5, a transmission set 10 of another preferred embodiment of the present invention is provided with the cord winding wheels 41 and 51 which have respectively an inverted tapered diameter. The transmission wheels 40 and 50 of the transmission set 10 are provided respectively with stopping pieces 411 and 412 for preventing the cords 42, 52 from moving aside and are further provided with the guide pieces 413 and 414 for enabling the cords 42 and 52 to wind of the cord winding wheels 41 and 51 correctly.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. An electric window blind, which comprises a blind body a transmission set having a motor provided with two rotary wheels mounted on a shaft of said motor, one of said rotary wheels provided with an action rod fastened thereto, said action rod provided at a bottom end thereof with a threaded portion engageable with a gear mounted on a rod, another one of said rotary wheels having a plurality of holes provided respectively therein with a plurality of balls, said another one of said rotary wheels further having retaining teeth at an end adjacent to an arresting block, said transmission set further having two transmission wheels mounted between said two rotary wheels such that said two transmission wheels are linked respectively with a cord winding wheel on which a cord is wound, with an end of said cord being located adjacent an idle wheel via a plurality of idle wheels; wherein said two rotary wheels are actuated by said motor to rotate such that one of said two rotary wheels actuates said transmission wheels which in turn actuate said cord winding wheels; and wherein said rod is actuated manually to cause said gear to turn so as to enable said action rod to bring about a displacement of said motor and to bring about the engagement of one of said rotary wheels with said transmission wheels so as to actuate said cord winding wheels, thereby resulting in the movement of said blind body by a cord wound on said cord winding wheel.

2. The electric window blind according to claim 1, wherein said blind body is fastened with said cord by a holding means such that said blind body is fixed on one side thereof by a fixation device and that said blind body is provided on another side thereof with an arresting ring.

3. The electric window blind according to claim 1, wherein said rotary wheels and said transmission wheels are provided respectively at one end thereof with a sector gear.

4. The electric window blind according to claim 1, wherein said transmission wheel has an inverted tapered wheel diameter and is provided with a stopping piece for preventing said cord from moving aside, said transmission wheel further provided with a guide piece for enabling said cord to wind on said cord winding wheel correctly.

* * * * *